US012250962B2

(12) United States Patent
Franke et al.

(10) Patent No.: US 12,250,962 B2
(45) Date of Patent: Mar. 18, 2025

(54) METHODS OF TREATING CUT STEM TOBACCO MATERIAL

(71) Applicant: BRITISH AMERICAN TOBACCO (INVESTMENTS) LIMITED, London (GB)

(72) Inventors: Dietmar Franke, Hamburg (DE); Frank Plueckhahn, Hamburg (DE); Matthias Link, Hamburg (DE); Horst Grzonka, Hamburg (DE); Thomas Lindner, Hamburg (DE)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 153 days.

(21) Appl. No.: 17/259,438

(22) PCT Filed: Jul. 10, 2019

(86) PCT No.: PCT/GB2019/051932
§ 371 (c)(1),
(2) Date: Jan. 11, 2021

(87) PCT Pub. No.: WO2020/012176
PCT Pub. Date: Jan. 16, 2020

(65) Prior Publication Data

US 2021/0274829 A1 Sep. 9, 2021

(30) Foreign Application Priority Data

Jul. 11, 2018 (GB) ..... 1811370

(51) Int. Cl.
*A24B 3/04* (2006.01)
*A24B 3/10* (2006.01)
*A24B 3/18* (2006.01)

(52) U.S. Cl.
CPC ..... *A24B 3/182* (2013.01); *A24B 3/10* (2013.01)

(58) Field of Classification Search
CPC ..... A24B 3/10; A24B 3/182; A24B 3/04; A24B 3/12; A24B 3/185; A24B 3/187
See application file for complete search history.

(56) References Cited

U.S. PATENT DOCUMENTS 4,513,759 A 4/1985 Wochnowski et al.
5,383,479 A 1/1995 Winterson et al.
(Continued)

FOREIGN PATENT DOCUMENTS

EP 0055541 3/1985
EP 2692246 2/2014
(Continued)

OTHER PUBLICATIONS

"International Preliminary Report on Patentability for Application No. PCT/GB2019/051932, mailed on Jan. 21, 2021", 9 pages.
(Continued)

*Primary Examiner* — Eric Yaary
(74) *Attorney, Agent, or Firm* — WOMBLE BOND DICKINSON (US) LLP

(57) ABSTRACT

A method of treating cut stem tobacco material by expanding the cut stem to provide a first expanded tobacco material having a fill value at least about 10% greater than the fill value of the untreated cut stem tobacco material; intermittently contacting the first expanded tobacco material with a heated surface to provide a second expanded tobacco material with a moisture content of from 0 to about 10% OV and a fill value at least 5% greater than the fill value of the first expanded tobacco material; and (c) adjusting the moisture content of the second expanded tobacco material from about 5% to about 30% OV to provide an expanded product, wherein the fill value of the expanded product is at least 50% greater than the fill value of the untreated cut stem tobacco material when measured at a normalized moisture content of 14.5% OV.

20 Claims, 3 Drawing Sheets

(56) References Cited

U.S. PATENT DOCUMENTS

| | | | | |
|---|---|---|---|---|
| 6,375,345 | B1 * | 4/2002 | Lepez | H05B 3/40 366/144 |
| 2017/0115055 | A1 * | 4/2017 | Lepez | B65G 33/24 |

FOREIGN PATENT DOCUMENTS

| | | | |
|---|---|---|---|
| EP | 2952105 | | 12/2015 |
| EP | 3087851 | | 11/2016 |
| GB | 2193076 | | 2/1988 |
| RU | 2126219 | C1 | 2/1999 |
| RU | 2504305 | C2 | 1/2014 |
| WO | WO8400284 | | 2/1984 |
| WO | WO2005117618 | | 12/2005 |
| WO | WO2012085198 | | 6/2012 |
| WO | WO2015063485 | | 5/2015 |
| WO | WO2019175552 | | 9/2019 |

OTHER PUBLICATIONS

"Office Action received for Russian Patent Application No. 2021103131, mailed on Jul. 30, 2021", 6 pages.
International Search Report and Written Opinion for PCT/GB2019/051932 date mailed Oct. 17, 2019.

* cited by examiner

METHODS OF TREATING CUT STEM TOBACCO MATERIAL

PRIORITY CLAIM

The present application is a National Phase entry of PCT Application No. PCT/GB2019/051932, filed Jul. 10, 2019 which claims priority from GB Patent Application No. 1811370.4 filed Jul. 11, 2018, each of which is hereby fully incorporated herein by reference.

FIELD

The present invention provides a method of treating cut stem tobacco material to produce an expanded cut stem product. Also provided is an apparatus for treating cut stem tobacco material. The invention also provides expanded cut stem tobacco material, tobacco industry products comprising the same, as well as uses and extracts thereof.

BACKGROUND

In order to improve the taste and burning characteristics of the tobacco stem for use in smokeable material, the stems are often first subjected to one or more treatment procedures, including, for example, expansion.

SUMMARY

According to a first aspect, the present invention provides a method of treating cut stem tobacco material comprising: (a) a first expansion step expanding the cut stem to provide a first expanded tobacco material having a fill value at least about 10% greater than the fill value of the untreated cut stem tobacco material when measured at a normalized moisture content of 14.5% oven volatiles (OV); (b) a second expansion step expanding the first expanded tobacco material by intermittently contacting the first expanded tobacco material with a heated surface to provide a second expanded tobacco material with a moisture content of from 0 to about 10% OV and a fill value at least 5% greater than the fill value of the first expanded tobacco material when measured at a normalized moisture content of 14.5% OV; and (c) a third step in which the moisture content of the second expanded tobacco material is adjusted to from about 10% to about 20% OV to provide an expanded product, wherein the fill value of the expanded product is at least 50% greater than the fill value of the untreated cut stem tobacco material when measured at a normalized moisture content of 14.5% OV.

In some embodiments, the third step further expands the second expanded tobacco material. In some embodiments, the fill value of the expanded product is at least 5% greater than the fill value of the second expanded tobacco material when measured at a normalized moisture content of 14.5% OV.

In some embodiments, the second expansion step comprises agitating the first expanded tobacco material.

In some embodiments, the heated surface used in the second expansion step has a temperature of from at least about 100° C. to about 300° C. prior to contact with the first expanded tobacco material. In some embodiments, the heated surface used in the second expansion step has a temperature of from at least about 120° C. to about 250° C., or from at least about 150° C. to about 300° C. prior to contact with the first expanded tobacco material.

In some embodiments, contacting the first expanded tobacco material with the heated surface in the second expansion step heats the tobacco material to a peak temperature of from about 120° C. to about 230° C.

In some embodiments, the second expanded tobacco material has a moisture content of from about 1% to about 5% OV, or of no greater than about 2% OV.

In some embodiments, the first expanded tobacco material is intermittently contacted with a heated surface in the second expansion step for a period of from at least about 1 minute to about 15 minutes. In some embodiments, the first expanded tobacco material is intermittently contacted with a heated surface in the second expansion step for a period of from at least about 2 minutes to about 10 minutes, or for a period of from at least about two and a half minutes to about 5 minutes.

In some embodiments, the cut stem tobacco starting material has a moisture content prior to the first expansion step of from about 20% to about 60% OV.

In some embodiments, the third step is a reordering step that adjusts the moisture content of the second expanded tobacco material to from about 10% to about 30% OV, or from about 10% to about 16% OV.

In some embodiments, the cut stem tobacco material has a fill value prior to the first expansion step of from about 3.5 to about 4.5 ml/g when measured at a normalized moisture content of 14.5% OV.

In some embodiments, the first expanded tobacco material has a fill value of from about 5 ml/g to about 8 ml/g when measured at a normalized moisture content of 14.5% OV.

In some embodiments, the expanded product has a fill value of from about 6.5 ml/g to about 12 ml/g when measured at a normalized moisture content of 14.5% OV.

In some embodiments, the method further comprises a resting phase between the first expansion step (a) and the second expansion step (b), and/or between the second expansion step (b) and the third step (c), wherein the resting phase comprises allowing the tobacco material to rest without being treated for a period of at least about 1 minute. In some embodiments, the resting phase comprises allowing the tobacco material to rest without being treated for a period of from about 1 hour to about 72 hours. In some embodiments, the resting phase comprises allowing the tobacco material to cool to a temperature no greater than about 40° C., or no greater than about 30° C.

In some embodiments, the first expansion step comprises exposing the cut stem to an expansion agent. In some embodiments, the expansion agent is selected from the group consisting of: liquid carbon dioxide, solid carbon dioxide, steam, liquid nitrogen, liquid short ($C_5$ or $C_6$) chain carbohydrates, or mixtures thereof.

In some embodiments, at least one of water and steam is added to the second expanded tobacco material during the third step.

According to a second aspect of the present invention, an apparatus is provided for carrying out a method according to the first aspect, the apparatus comprising a module for carrying out the second expansion step, the module comprising a heated surface provided to intermittently contact the first expanded tobacco material.

In some embodiments, the heated surface of the module for carrying out the second expansion step has a temperature of from at least about 120° C. to about 250° C. prior to contact with the tobacco material, or from at least about 150° C. to about 300° C. prior to contact with the tobacco material.

In some embodiments, the module for carrying out the second expansion step comprises a treatment chamber including the heated surface and at least one mechanism for agitating the tobacco material selected from the group consisting of: a screw mechanism; a dual screw mechanism; air flow; and a rotating drum.

In some embodiments, the apparatus further comprises a module for carrying out the first expansion step. In some embodiments, said module for carrying out the first expansion step comprises any conventional expansion technology, optionally selected from the group consisting of: an expansion steaming tunnel, an STS (Steam Treated Stem) system, conditioning cylinder, a conditioning screw, or a pressurized conditioning screw. In some embodiments, the module for carrying out the first expansion step further comprises any conventional drying technology, optionally selected from the group consisting of: a fluidized bed dryer, a flash tower dryer, a rotary dryer and a band dryer.

In some embodiments, the apparatus further comprises a module for carrying out the third step. In some embodiments, the module for carrying out the third step comprises one or more selected from the group consisting of: a reordering drum, a steaming tunnel, and a band conditioner.

According to a third aspect of the present invention, an expanded cut stem tobacco material is provided, obtained or obtainable by a method according to the first aspect, which has a fill value at least 50% greater than the fill value of the untreated cut stem tobacco material when measured at a normalized moisture content of 14.5% OV.

In some embodiments, the expanded cut stem tobacco material has a fill value of from about 6.5 to about 12 ml/g when measured at a normalized moisture content of 14.5% OV.

According to a fourth aspect of the present invention, a tobacco industry product is provided, comprising the expanded cut stem tobacco material of the third aspect.

According to a fifth aspect of the present invention, use of the expanded cut stem tobacco material of according to the third aspect is provided, for the manufacture of a tobacco industry product.

BRIEF DESCRIPTION OF THE FIGURES

Embodiments of the present invention will now be described, by way of example only, with reference to the accompanying drawings, in which.

DETAILED DESCRIPTION

Figure 1:
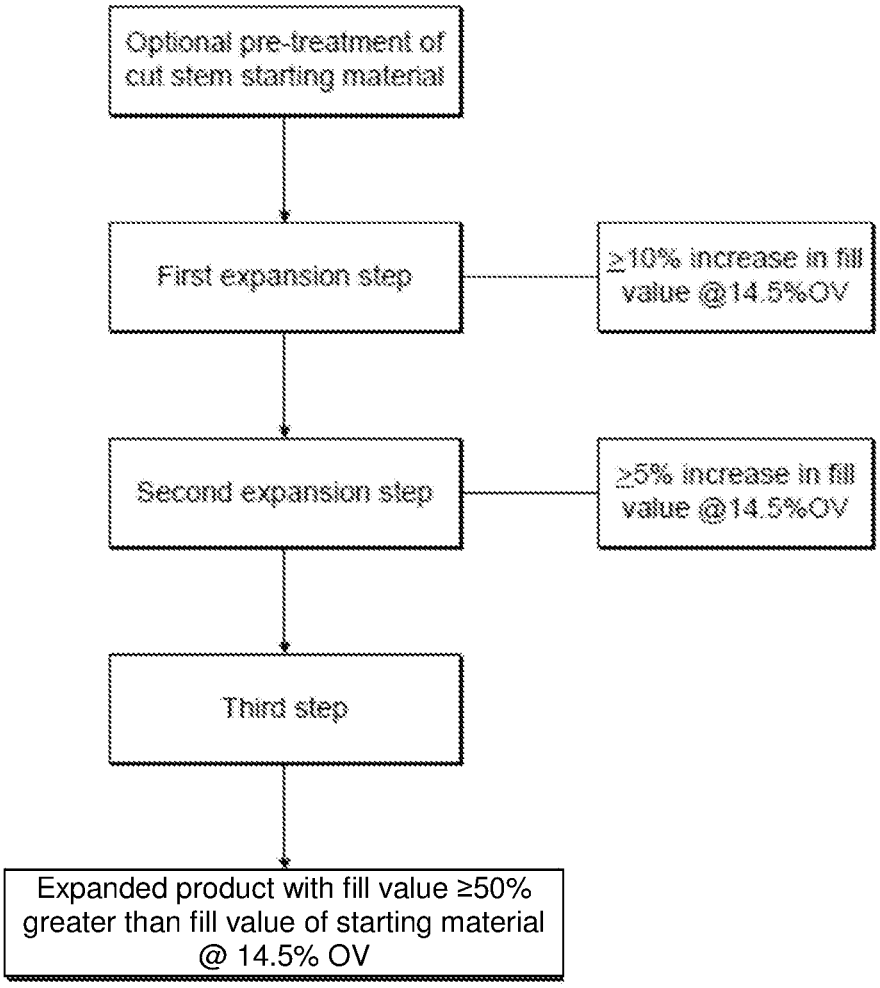
FIG. 1 shows a process flow chart of an exemplary method.

The invention relates to a process for producing expanded tobacco stems. The stem is a relatively woody part of the tobacco leaves, providing structural rigidity. The stems can make up as much as 20 to 30% by weight of the tobacco leaves. They generally contain lower levels of alkaloids and other nitrogenous compounds, but higher levels of cellulose. Upon combustion, stems generate smoke that is considered to be inferior compared to other parts of the leaf. However, to improve yield, cut tobacco stem may be included with cut lamina in smokeable material for smoking articles such as cigarettes.

In order to improve the taste and burning characteristics of the tobacco stem for use in smokeable material, the stems are often first subjected to one or more treatment procedures, including, for example, casing application and expansion.

The invention relates to methods of treating cut stem to achieve expansion of the stem in different process phases.

Expansion of the stem increases its fill value, which is the volume occupied by a given weight or mass of the material. The greater the fill value of a tobacco material, the lower the weight of the material required to fill a tobacco rod of a cigarette of standard dimensions.

The fill value of a tobacco material such as expanded tobacco stem may be expressed in terms of the "Corrected Cylinder Volume" (CCV), which is the cylinder volume (CV) of the tobacco material at a normalized moisture content of 14.5% oven volatiles (OV). The cylinder volume (CV) may, for example, be determined using a Borgwaldt densimeter DD60 or DD60A type fitted with a measuring head for cut tobacco and a tobacco cylinder container. In one suitable method for determining the CCV, a sample of tobacco material is placed in the tobacco cylinder container of the Borgwaldt densimeter and subjected to a load of 2 kg for 30 seconds. The height of the sample after this compression by the load is measured and this is used to calculate the measured cylinder volume (CV). The tobacco stem fill value, which is an inverse density, is strongly dependent upon the moisture content of the material. Therefore, if the tobacco material used to measure the CV did not have a moisture content of 14.5%, the CCV, and thus the corrected fill value, can be calculated using a well-known formula. For example, the corrected fill value can be calculated according to the following formula:

$$FF_{korr.} = FF \cdot \frac{100 - 14,5}{100 - \text{moist}} \cdot \left(\frac{\text{moist}}{14,5}\right)^{0.8}$$

where $FF_{korr}$ is the corrected fill value, FF is the uncorrected fill value, and moist refers to the moisture of the tobacco material as measured.

The determination of moisture content is important in the tobacco industry because moisture has a great influence on tobacco materials, their processing properties and on the finished product itself. When referring to "moisture" it is important to understand that there are widely varying and conflicting definitions and terminology in use within the tobacco industry. It is common for "moisture" or "moisture content" to be used to refer to water content of a material but in relation to the tobacco industry it is necessary to differentiate between "moisture" as water content and "moisture" as oven volatiles. Water content is defined as the percentage of water contained in the total mass of a solid substance. Volatiles are defined as the percentage of volatile components contained in the total mass of a solid substance. This includes water and all other volatile compounds. Oven dry mass is the mass that remains after the volatile substances have been driven off by heating. It is expressed as a percentage of the total mass. Oven volatiles (OV) are the mass of volatile substances that were driven off.

Moisture content (oven volatiles) may be measured as the reduction in mass when a sample is dried in a forced draft oven at a temperature regulated to 110° C.±1° C. for three hours±0.5 minutes. After drying, the sample is cooled in a desiccator to room temperature for approximately 30 minutes, to allow the sample to cool.

Unless stated otherwise, references to moisture content herein are references to oven volatiles (OV).

As used herein, the terms "treated tobacco material" and "expanded product" refer to cut stem tobacco material that has undergone the treatment process of the invention, and the terms "untreated cut stem tobacco material" or "cut stem starting material" refer to cut stem tobacco material that has not undergone the treatment process of the invention (although it may have undergone other processing).

As used herein, the term "cut stem tobacco material" includes stems of any member of the genus *Nicotiana*. The cut stem tobacco material for use in the present invention is preferably from the species *Nicotiana tabacum*.

Cut stems of any type, style and/or variety of tobacco may be treated. Examples of tobacco which may be used include, but are not limited to, Virginia, Burley, Oriental, Comum, Amarelinho and Maryland tobaccos, and blends of any of these types. The skilled person will be aware that the treatment of different types, styles and/or varieties will result in tobacco with different organoleptic properties.

The cut stem tobacco material to be treated may be derived from tobacco material that has been pre-treated according to known practices. For example, the tobacco material may comprise and/or consist of post-curing tobacco. As used herein, the term 'post-curing tobacco' refers to tobacco that has been cured but has not undergone any further treatment process to alter the taste and/or aroma of the tobacco material. The post-curing tobacco may have been blended with other styles, varieties and/or types. Post-curing tobacco does not comprise or consist of cut rag tobacco.

Alternatively or in addition, the cut stem tobacco material to be treated may be derived from tobacco that has been processed to a stage that takes place at a Green Leaf Threshing (GLT) plant. This may comprise tobacco that has been re-graded, green-leaf blended, conditioned or threshed, dried and/or packed.

An exemplary method of the present invention is illustrated in the flow chart of FIG. 1. The cut stem tobacco starting material may optionally have undergone pre-treatment, such as the conventional primary manufacturing (PMD) processes, which include, for example, one or more of: conditioning of raw stem, subsequent rolling, cutting, drying and mixing. The flow chart shows exemplary processing steps that are included in some embodiments of the methods for treating cut stem tobacco material.

First Expansion Step

In methods according to the present invention, cut stem tobacco material is treated by a first expansion step which expands the cut stem to provide a first expanded tobacco material having a fill value at least about 10% greater than the fill value of the untreated cut stem tobacco material when measured at a normalized moisture content of 14.5% OV.

In some embodiments, the first expansion step starts with cut stem which will usually have a moisture content of from about 20% to about 60% oven volatiles (OV), or from about 20% to about 40% OV prior to the first expansion step.

In some embodiments, the first expansion step starts with cut stem which has a fill value of from about 3.5 to about 4.5 ml/g prior to the first expansion step when measured at a normalized moisture content of 14.5% OV.

In some embodiments, the first expansion step utilizes conventional expansion techniques.

Various methods have been proposed for expanding tobacco, including the impregnation of tobacco with a gas or steam under pressure and the subsequent release of the pressure, whereby the gas causes expansion of the tobacco cells to increase the volume of the treated tobacco. This may involve the use of so-called Steam Treated Stems processes and equipment, or steam tunnels.

Other methods include the impregnation of tobacco with a liquid, such as water or relatively volatile organic liquids, after which the liquid is driven off to expand the tobacco. A widespread conventional expansion technique involves the use of dry ice, resulting in so-call dry-ice expanded tobacco or DIET. The process involves permeating the tobacco with liquid carbon dioxide before warming. The resulting carbon dioxide gas forces the tobacco to expand.

Additional methods include the treatment of tobacco with solid materials which, when heated, decompose to produce gases which serve to expand the tobacco. Other methods include the treatment of tobacco with gas-containing liquids, such as carbon dioxide-containing water, under pressure to impregnate the tobacco with the liquid. The impregnated tobacco is then heated or the pressure reduced to cause release of the gas and expansion of the tobacco. Additional techniques have been developed for expanding tobacco which involve the treatment of tobacco with gases which react to form solid chemical reaction products within the tobacco, for example carbon dioxide and ammonia to form ammonium carbonate. These solid reaction products may subsequently be decomposed by heat to produce gases within the tobacco which cause expansion of the tobacco upon their release. Tobacco stems may also be expanded by utilizing various types of heat treatment or microwave energy. Freeze-drying of tobacco can also be employed to obtain an increase in volume. Consecutive drying techniques may also be used to expand cut stems, such as air drying, and fluidized bed drying, etc.

In some embodiments, the first expansion step comprises exposing the cut stem to an expansion agent. The expansion agent may be selected from the group consisting of: liquid carbon dioxide, solid carbon dioxide, steam, liquid nitrogen, liquid short ($C_5$ or $C_6$) chain carbohydrates, or mixtures thereof.

In some embodiments, the first expanded tobacco material is dry ice expanded tobacco (DIET).

It is known that such conventional expansion techniques can result in an increase in the fill value of at least about 10%. Following an expansion step using one of the aforementioned conventional expansion techniques, the cut stem may have an expanded fill value of from about 5 ml/g to about 6 ml/g when measured at a normalized moisture content of 14.5% OV. These figures for expansion are on the conservative side and represent the minimum expansion effects of known, conventional expansion and drying processes. In reality, the expansion effects of known expansion techniques can potentially be more pronounced. For example, the cut stem of the first expanded tobacco material may have an expanded fill value of from about 5 ml/g to about 10 ml/g, such as from about 5 ml/g to about 9 ml/g, such as from about 5 ml/g to about 8 ml/g, such as from about 5 ml/g to about 7 ml/g when measured at a normalized moisture content of 14.5% OV.

In some embodiments, the first expansion step expands the cut stem to provide a first expanded tobacco material having a fill value at least about 12%, at least about 15%, at least about 20%, at least about 25%, at least about 30%, at least about 35%, at least about 40%, at least about 50%, at least about 60%, at least about 70%, at least about 80%, at least about 90%, or at least about 100% greater than the fill value of the untreated cut stem tobacco material when measured at a normalized moisture content of 14.5% OV.

In some embodiments, the moisture content of the first expanded tobacco material (the tobacco material after the first expansion step) is from about 5% to about 25% OV, such as from about 5% to about 20% OV, such as from about 10% to about 15% OV.

The first expanded tobacco material resulting from the first expansion step will comprise an expanded stem. This first expanded tobacco material may, for example, have a fill value of from about 5 ml/g to about 7 mg/l when measured at a normalized moisture content of 14.5% OV. This material is the infeed material for the second expansion step.

Second Expansion Step

The second expansion step involves expanding the first expanded tobacco material by intermittently contacting the first expanded tobacco material with a heated surface to provide a second expanded tobacco material with a moisture content of from 0 to about 10% oven volatiles (OV) and a fill value at least about 5% greater than the fill value of the first expanded tobacco material when measured at a normalized moisture content of 14.5% OV.

The second expansion step is dominated by the additional drying of the first expanded tobacco material, that is the expanded cut stem from the first expansion step. In some embodiments, the starting material for the second expansion step (the first expanded tobacco material) has a moisture content of from about 5 to about 25% OV. The second expansion step results in drying so that the resultant second expanded tobacco material has a moisture content of from 0% to about 10% OV, such as from 0% to about 5% OV.

In addition, the second expansion step results in further expansion of the tobacco material, so that the fill value of the second expanded material is at least about 5% more than the first expanded tobacco material when measured at a normalized moisture content of 14.5% OV. In some embodiments, the second expansion step expands the first expanded tobacco material to provide a second expanded tobacco material having a fill value at least about 7%, at least about 10%, at least about 15%, at least about 20%, at least about 25%, at least about 30%, at least about 35%, or at least about 40% greater than the fill value of the cut stem tobacco material before second expansion step (the first expanded tobacco material) when measured at a normalized moisture content of 14.5% OV.

In some embodiments, the second expanded tobacco material has a fill value of from about 5.5 ml/g to about 10 ml/g when measured at a normalized moisture content of 14.5% OV. In some embodiments, the second expanded tobacco material has a fill value of from about 6 ml/g to about 9 ml/g, such as from about 6 ml/g to about 8 ml/g.

The second expansion step is a novel treatment of cut stem and comprises intermittently contacting the first expanded tobacco material with a heated surface. The intermittent contact of the tobacco with the heated surface results in a repetitive short term exposure to intense heat. In some embodiments, this intermittent contact may be achieved by agitating the tobacco material being treated. The temperature of the heated surface, and thus the temperature to which the tobacco material is exposed, is significantly higher than about 100° C., and, in some embodiments, is at least about 150° C. Therefore, the intermittent contact is important in order to ensure that the tobacco material is not burnt as a result of prolonged continuous exposure to surfaces at such high temperatures.

In some embodiments, the intermittent contact of the tobacco with the heated surface results in the tobacco material being seared or scorched. This is as a result of the exposure to a sudden and intense heat. This has a drying effect but also results in a treatment of the tobacco that is different to the gentle drying processes known in the prior art.

In some embodiments, the oxygen levels surrounding the tobacco material during treatment may be reduced. This may have the effect of reducing the risk of 'hot spots' forming as a result of the exposure to the heated surface, and to reduce the risk of the tobacco material burning. Such reduction in the oxygen level can therefore allow the tobacco material to be treated at higher temperatures than in the prior art processes and apparatus. In some embodiments, the oxygen level is reduced by the application of steam.

Without wishing to be bound by any particular theory or theories, it is hypothesized that the process can be split into two phases. During the first phase, the tobacco material is being dried as a result of the exposure to the heat which drives off volatile components, including water, in a kind of steam distillation of the tobacco material. During the second phase, an effect which is referred to herein as "searing" occurs. It is during this second phase that the main chemical changes in the tobacco material appear to occur.

It is hypothesized that the brief contact of the tobacco material with the heated surface, and the local searing of the tobacco, may lead to an increase in the products of the Maillard and caramelization reactions, many of which are known to contribute to desirable organoleptic properties. This is discussed in more detail in Example 1 below. The Maillard reaction is a chemical reaction between amino acids and sugars, and these are present in the tobacco starting material, but are seen in reduced quantities in the treated tobacco material. It is a non-enzymatic reaction which typically occurs at temperatures of from about 140 to 165° C. In addition to the pleasing effects of the Maillard reaction products on the organoleptic properties, the reaction is also responsible for the browning of materials. It has been observed that the tobacco material treated in accordance with embodiments of the second expansion step of the present invention has a darker brown color than the starting material.

In some embodiments, treating expanded cut stem tobacco material using the second expansion step as described herein produces a tobacco with an enhanced flavor profile or enhanced organoleptic properties (compared to the flavor profile of tobacco which has not been treated or which has been treated using only conventional curing processes). This means that there is a reduction in off-notes or irritants, whilst retaining the taste characteristics of the cut stem tobacco material as would be seen following conventional curing. As used herein, the terms "enhance" or "enhancement" are used in the context of the flavor or organoleptic properties to mean that there is an improvement or refinement in the taste or in the quality of the taste, as identified by expert smokers. This may, but does not necessarily, include a strengthening of the taste.

Reference made herein to the organoleptic properties of the tobacco material may be reference to the organoleptic properties of the tobacco material itself, for example when used orally by a consumer. Additionally, or alternatively, the reference is to the organoleptic properties of smoke produced by combusting the tobacco material, or of vapor produced by heating the tobacco material. In some embodiments, the treated tobacco material affords a tobacco product including said tobacco material with desirable organoleptic properties when said product is used or consumed.

In some embodiments, the methods of the present invention have the unexpected advantage of mitigating the negative sensorial effects of stem to the overall performance of a blend. The mouthcoating, cellulosic and 'stemmy' taste contribution is seen to be a downside of the overall stem characteristics.

It is further hypothesized that the searing also has a physical effect on the tobacco material, causing individual cells within the plant material to expand as the moisture inside them is rapidly heated and evaporates. This expansion occurs even where the cut stem being treated has already been expanded in a first expansion step.

In some embodiments, the temperature of the heated surface is in the range of from about 100° C. to about 300° C. In some embodiments the temperature is at least about 105° C., 110° C., 115° C., 120° C., 125° C., 130° C., 135° C., 140° C., 145° C., 150° C., 155° C., 160° C., 165° C., 170° C., 175° C., 180° C., 185° C., 190° C., 195° C. or at least about 200° C. In some embodiments the temperature of the heated surface is up to about 295° C., 290° C., 285° C., 280° C., 275° C., 270° C., 265° C., 260° C., 255° C., 250° C., 245° C., 240° C., 235° C., 230° C., 225° C., 220° C., 215° C., 210° C., 205° C. or up to about 200° C. In some embodiments, the heated surface has a temperature of from at least about 120° C. to about 250° C., or from at least about 150° C. to about 300° C.

When discussing the temperature of the heated surface, reference is made herein to the temperature prior to contact with the tobacco material. This is because the contact with the tobacco material and the drying process can lead to cooling of the heated surface. Therefore, the exact temperature of the heated surface during the drying process will depend on how much "drying work" is done. For example, in the initial stages where water is being evaporated from the tobacco material, a greater amount of energy will be utilized, thus leading to greater cooling of the heated surface. It is therefore the temperature of the heated surface prior to contact with the tobacco material that can be readily and accurately determined.

In some embodiments, the temperature of the heated surface is controlled to minimize significant changes during the treatment process. For example, a feedback mechanism may be used to ensure that the temperature is maintained within an acceptable range, heating the surface when the temperature drops as a result of the treatment of tobacco material.

In some embodiments, it is appropriate to adjust the temperature of the heated surface according to the type of tobacco material being treated. One reason why this is appropriate is that the different tobacco materials have different starting moisture contents and so treatment will involve removing different amounts of moisture and volatiles.

The characteristics of the resulting tobacco material are seen as a combination of surface temperature, residence time and tobacco mass flow, which are all contributing to an 'average' tobacco temperature and hence to the changes within the individual tobacco particle.

In some embodiments, the heated surface is metal, such as stainless steel, or any other appropriate steel and metal types with sufficient heat transfer characteristics. In other embodiments, the heated surface is made from any material with sufficient heat transfer characteristics that can be heated to the temperatures used in the methods described herein. For example, ceramic surfaces may be used.

The heated surface may, for example, be heated indirectly by a heating medium, such as a heating medium selected from the group consisting of oils, water or steam. In some embodiments, thermal oils are the preferred heating medium. Alternatively or in addition, the heated surface may be heated directly. In some embodiments, the heated surface is heated by electricity.

In some embodiments, the heated surface has a temperature prior to contact with the tobacco material of at least about 200° C. for treating cut stem tobacco material, and optionally in the range of from about 220° C. to about 250° C.

When the tobacco material is intermittently and repeatedly contacted with the heated surface, this will heat the tobacco material. Given the high temperatures of the heated surface, the temperature of the tobacco is raised significantly. In some embodiments, as a result of the treatment method, the temperature of the tobacco material is raised to a peak temperature in the range of from about 120° C. to about 230° C. In some embodiments the peak temperature of the tobacco material is at least about 125° C., 130° C., 135° C., 140° C., 145° C., 150° C., 155° C., 160° C., 165° C., 170° C., 175° C., 180° C., 185° C., 190° C., 195° C., 200° C., 205° C., 210° C., 215° C. or at least about 220° C. In some embodiments the peak temperature of the tobacco material is up to about 225° C., 220° C., 215° C., 210° C., 195° C., 190° C., 185° C., 180° C., 175° C., 170° C., 165° C., 160° C., 155° C., 150° C., 145° C., 140° C., 135° C., 130° C. or up to about 125° C. The temperature of the tobacco material may be measured with suitable measurement devices, such as infrared measurement or electrical resistance thermometers.

In some embodiments, the tobacco material is heated under an inert atmosphere. In some embodiments, an inert gas, such as nitrogen, saturated steam, carbon dioxide or mixtures thereof, is added in the apparatus to control the oxygen level and thereby steer desired chemical reaction during processing.

The treatment of the cut stem tobacco material in the second expansion step has a drying effect and the moisture content of said tobacco material is reduced. The second expanded tobacco material has a moisture content of from 0% to about 10% oven volatiles (OV). In other words, the second expanded tobacco material has a moisture content of no greater than about 10% OV. In some embodiments, the moisture content of the second expanded tobacco material is no greater than about 9.5%, 9%, 8.5%, 8%, 7.5%, 7%, 6.5%, 6%, 5.5%, 5%, 4.5%, 4%, 3.5%, 3%, 2.5%, 2%, 1.5%, 1% or no greater than about 0.5% OV. In some embodiments, the second expanded tobacco material has a moisture content of from about 1% to about 5% OV, or of no greater than about 2% OV.

In some embodiments, the first expanded tobacco material (i.e., the starting material for the second expansion step) has a moisture content of at least about 5% OV. In some embodiments, the moisture content of the first expanded tobacco material is at least about 6%, 7%, 8%, 9%, 10%, 11%, 12%, 13%, 14%, 15%, 16%, 17%, 18%, 19%, 20%, 21%, 22%, 23%, or at least about 24% OV. In some embodiments, the moisture content of the first expanded tobacco material is no greater than about 25%, 24%, 23%, 22%, 21%, 20%, 19%, 18%, 17%, 16%, 15%, 14%, 13%, 12%, 11%, 10%, 9%, 8%, 7%, or no greater than about 6% OV. In some embodiments, the first expanded tobacco material has a moisture content of from at least about 5% to about 25% OV, or from at least about 5% to about 20% OV. In some embodiments, the first expanded tobacco material has a moisture content of from at least about 12% to about 16% OV.

Thus, in some embodiments, the primary purpose of the second expansion step is not to further reduce the moisture content of the first expanded tobacco material, but to achieve the physical and chemical changes to the tobacco material caused by the searing caused by the brief contact with the high temperature of the heated surface, including the further expansion of the material and the attendant increase in its fill value. In some embodiments, this effect is achieved without burning or substantially without burning the tobacco material as a result of the contact with the heated surface.

In some embodiments, the moisture content of the tobacco material may be adjusted during the second expansion step by adding moisture. Moisture may be introduced in the second expansion step in the form of water or steam. This may be sprayed onto the tobacco material whilst it is being intermittently contacted with a heated surface.

In some embodiments, this introduction of moisture increases the moisture content of the tobacco material by 2% to 5% OV. In some embodiments, the moisture is introduced at different positions throughout the second expansion step.

As this moisturizing of the tobacco is occurring during the second expansion step, the moisture content will be reduced again as the moisturized tobacco contacts the heated surface. The second expansion step may include multiple additions of moisture, so that the moisture content of the tobacco material fluctuates up and down repeatedly during the treatment step.

In some embodiments, the second expansion step involves repeatedly and intermittently contacting tobacco material with one or more heated surfaces over a treatment period of from at least about 1 minute to about 15 minutes. In some embodiments, the period for which the tobacco material is intermittently contacted with the heated surface is at least about 1 minute, 2, 3, 4, 5, 6, 7, 8, 9, 10, 11, 12, 13 or at least about 14 minutes. In some embodiments, the period for which the tobacco material is intermittently contacted with the heated surface is up to about 14 minutes, 13, 12, 11, 10, 9, 8, 7, 6, 5, 4, 3 or up to about 2 minutes. In some embodiments, the tobacco material is contacted with the heated surface for a total period of from at least about 2 minutes to about 10 minutes, or from at least about 2.5 minutes to about 5 minutes.

The intermittent contact may involve the tobacco material being in direct and continuous contact with a heated surface for a period of up to about 5 seconds. In some embodiments, the average length of the period(s) of direct and continuous contact is from about 0.1 seconds to about 3 seconds.

Reference herein to intermittent contact of the tobacco material with the heated surface means that any part of the tobacco material is only temporarily in direct contact with the heated surface. In some embodiments, this means that the tobacco material is moved relative to the heated surface, to prevent the tobacco material coming to rest in a particular position in contact with the heated surface for too long, and/or ensuring that the same part of the tobacco material does not remain in direct contact with the heated surface for too long. Extended contact of the same part of the tobacco material with the heated surface will lead to burning which will have a detrimental effect on the physical and chemical properties of the tobacco material and will render the treated material less suitable for further use, for example in a tobacco industry product.

In some embodiments, the second expansion step includes agitating the tobacco material as it is treated. In some embodiments, an apparatus is provided which includes a means for agitating the tobacco material during the second expansion step.

In some embodiments, it is preferred that the tobacco material is agitated during the second expansion step by tumbling the tobacco material. This may, for example, be achieved by picking up the tobacco material being treated, lifting it and then allowing it to fall, creating a tumbling movement of the tobacco material.

In some embodiments, the movement of the tobacco material during the second expansion step may be created by a mechanism such as one comprising one or more screws. In such an arrangement, the screw includes a helical surface encircling a shaft which is rotated, wherein the helical surface is configured to pick up tobacco material. As the shaft rotates, the helical surface scoops up at least a portion of the tobacco material being treated. This tobacco material is then carried and lifted by the rotating helical surface until the rotation of the screw allows it to fall (under gravity) away from the screw. In some embodiments, the screw or screws may be positioned to move tobacco material through a treatment chamber, as well as to agitate the tobacco material. Such an arrangement allows tobacco material to be treated in a continuous manner. In some embodiments, the helical surface and/or the shaft of the screw may be heated to provide the heated surface used to treat the tobacco material. Where two screws are used to move the tobacco material, these screws may be positioned in parallel and are positioned to contact and move all of the tobacco to be treated. In some embodiments, the screw may include additional paddles to assist the picking up and carrying of the tobacco material. These paddles may also be heated surfaces used to treat the tobacco material.

In other embodiments, the tobacco material may be agitated during the second expansion step in a rotating drum. The inside of the drum may be the chamber within which the tobacco is treated. The tobacco lies inside the drum and may be picked up from the bottom of the drum and lifted as the drum rotates. The picking up of the tobacco material may be facilitated by the drum having an inner surface which is capable of maintaining contact with the tobacco material, for example by virtue of having a rough surface or protrusions, such as paddles, which scoop up the tobacco material. As the drum rotates, the tobacco in contact with the drum's inner surface is lifted until the rotation of the drum allows it to fall (under gravity) away from the drum wall and back to the bottom of the drum. This can create a tumbling and mixing of the tobacco material. The irregularities on the inner surface of the drum may help to control how long the tobacco material remains in contact with the drum wall. The irregularities may also be used to ensure that the tobacco material does not remain in contact with the drum wall as it falls (sliding back down the wall), thereby enhancing the tumbling movement of the tobacco material. The speed of rotation will also affect the tumbling motion, as will the orientation of the axis of rotation. In some embodiments, the inner surface of the drum may be the heated surface used to treat the tobacco. The drum may rotate about a horizontal or substantially horizontal axis. In other embodiments, rotation about an inclined axis may allow the tobacco to maintain contact with the drum inner surface for longer and will also move the tobacco in a longitudinal direction. Longitudinal movement of the tobacco as a result of the rotation of the drum may additionally or alternatively be achieved by having appropriately positioned and/or angled protrusions on the inner surface of the drum.

In other embodiments, the tobacco material may be agitated during the second expansion step by air flow. For example, tobacco material is picked up and moved by air flow.

In some embodiments, the tobacco material is not agitated during the second expansion step by the flow of air through the device. In some embodiments, the apparatus for treating tobacco material does not include means for pumping of air through the apparatus to agitate the tobacco material during the second expansion step.

In some embodiments, the second expansion step is a continuous method. For example, first expanded tobacco material is continuously fed into the apparatus, is treated and then leaves the apparatus as the second expanded tobacco material. In alternative embodiments, the second expansion step is a batch process, in which a batch of first expanded tobacco material is fed into the apparatus, processed to produce a batch of second expanded tobacco material which is removed before a new batch is processed.

The process parameters of the second expansion step are sufficiently gentle for the treated tobacco material to maintain some or all of its physical properties. For example, the cut stem tobacco material remains sufficiently intact following the second expansion step to allow handling and/or processing for incorporation into a tobacco-containing product, such as a smoking article. This enables the treated tobacco material to undergo handling in accordance with standard processes, in the same manner as conventional tobacco which has not undergone the processing as described herein.

Third Step

The third step in the methods of the present invention is a reordering, remoistening and/or conditioning step comprising treating the second expanded tobacco material produced by the second expansion step. In some embodiments, the third step is a reordering step. In some embodiments, the third step is a conditioning step. In some embodiments, the third step is a remoistening step.

The moisture content of the second expanded tobacco material is from 0% to about 10% OV. The third step increases the moisture content of the treated material to from about 10% to about 20% OV, and preferably from about 10% to about 16% OV.

In some embodiments, the third step involves the use of conventional reordering or conditioning techniques. In some embodiments, at least one of water and steam is added to the second expanded tobacco material during the third step.

The apparatus or module used to perform the third step may include, for example, a reordering drum, a steaming tunnel, or a band conditioner, etc.

The third step produces an expanded product and in some embodiments the third step further increases the fill value of the material being treated (i.e. the second expanded tobacco material). In some embodiments, the expanded product has a fill value which is at least 5% greater than the fill value of the second expanded tobacco material when measured at a normalized moisture content of 14.5% OV.

In some embodiments, the third step expands the second expanded tobacco material to provide an expanded product having a fill value at least about 7%, at least about 10%, at least about 15%, at least about 20% greater than the fill value of the untreated cut stem tobacco material when measured at a normalized moisture content of 14.5% OV.

In some embodiments, the expanded product has a fill value of from about 6 ml/g to about 12 ml/g when measured at a normalized moisture content of 14.5% OV.

The overall increase in the fill value of the cut stems following their expansion by virtue of the combination of the first expansion step, the second expansion step and the reordering step is at least about 50%, when measured at a normalized moisture content of 14.5% OV, and optionally is at least about 60%, at least about 70%, at least about 80%, at least about 90%, or at least about 100%. In some embodiments, the overall increase in the fill value of the cut stems following their expansion by virtue of the combination of the first expansion step, the second expansion step and the third step is up to about 300%, such as up to about 250%, such as up to about 200%, when measured at a normalized moisture content of 14.5% OV.

For example, the fill value of the cut stem tobacco material may increase from a starting value of from about 4 ml/g to about 6 ml/g before treatment to from about 6 ml/g to about 10 ml/g.

Intermediate Steps

In some embodiments, the method further comprises a resting phase between the first expansion step and the second expansion step, and/or between the second expansion step and the third step.

In some embodiments, the resting phase comprises allowing the tobacco material to rest without being treated for a period of at least about 1 minute. In some embodiments, the resting phase may be for a period of at least 2 minutes, at least 3 minutes, at least 4 minutes or at least 5 minutes, or for a period of from about 1 minute to about 60 minutes, or from about 1 minute to about 30 minutes. In some embodiments, the resting phase may be for a period of from about 1 hour to about 72 hours, such as from about 1 hour to about 48 hours, such as from about 1 hour to about 24 hours, such as from about 1 hour to about 12 hours, or such as from about 1 hour to about 6 hours.

In some embodiments, the resting phase comprises allowing the tobacco material to cool to a temperature of no higher than about 40° C., or no higher than about 30° C. before the next treatment step.

In some embodiments, after a treatment step, the treated tobacco material may be cooled. In some embodiments, this may involve the use of a cooling belt, where ambient air or cooled air is passed through a layer of processed tobacco. In other embodiments, the tobacco may be cooled by any one or more of the following steps: resting, passing through a cooling cylinder, air lifting, and cooling via fluidized bed, etc.

Apparatus

The methods of the present invention may be carried out in any suitable apparatus or any suitable combination of apparatus. An apparatus may comprise modules for carrying out one of more of the processing steps. For example, an apparatus may comprise a first module for carrying out the first expansion step, a second module for carrying out the second expansion step and a third module for carrying out the third step.

Figure 2:
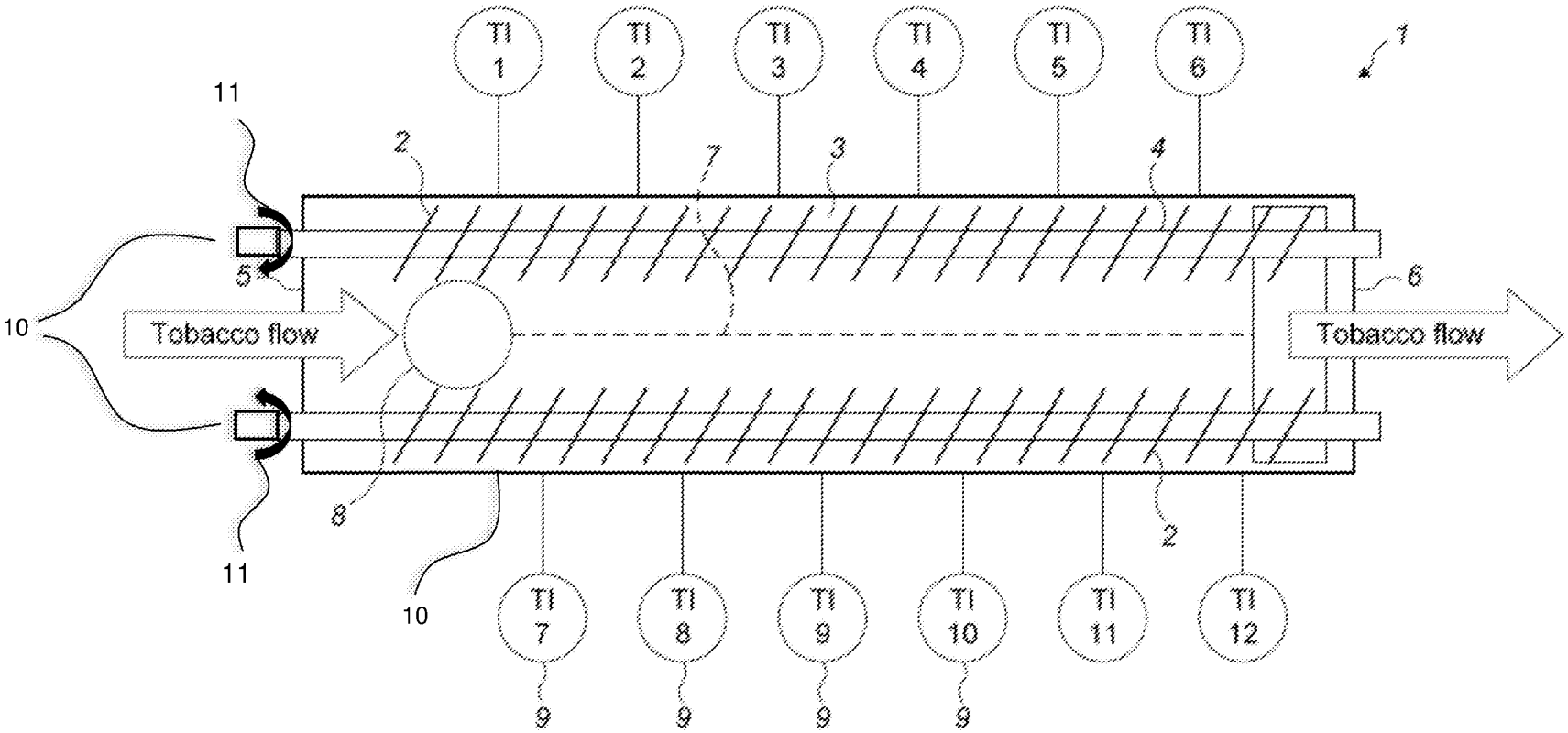
FIG. 2 is a schematic illustration of the progress of the tobacco material through an apparatus for a step of the method of treating tobacco material.

A specific illustrative example of an apparatus (or module of an apparatus) suitable for carrying out embodiments of the second expansion step of the methods described herein is shown in FIG. 2. In this embodiment, the apparatus 1 includes two screws 2 in a dual screw arrangement. It is believed that this arrangement means that any part of the tobacco material may only be in contact with the heated surface for a period in the order of seconds at any one time as a result of the agitation or turbulence generated by the screws in the apparatus.

The tobacco material 8 is treated in the apparatus 1 including conveying screws 2 which include a helical surface 3 and shaft 4, wherein the screws 2 move the tobacco material through the treatment chamber 7 of the apparatus 1. The screws 2 are rotated and the shafts 4 of the screws 2 are rotated by a drive mechanism 11, including a motor.

The tobacco starting material enters the treatment chamber 7 via the tobacco inlet 5, whereupon the rotating screws pick up the tobacco material, tumbling it and moving it through the treatment chamber towards the tobacco outlet 6.

More specifically, a mass of tobacco material 8 enters the treatment chamber 7 through the tobacco inlet 5. As the screw 2 rotates, the tobacco material is picked up, with some of the tobacco material coming into direct contact with the helical surface 3 and possibly also the shaft 4 of the screw 2. The tobacco material is dragged along, lifted and dropped by the screw 2, so that it is both conveyed through the treatment chamber 7 and tumbled. Tobacco which has been lifted as a result of the rotating screw(s) subsequently falls into the mass of tobacco material 8 being conveyed through the chamber 7, and the mass is constantly being mixed and moved, resulting in different parts of the mass coming into contact with the screws 2 at different times.

In the illustrated embodiment, the surfaces of the screws 2 are heated and they contact the tobacco material intermittently, in accordance with the methods for treating the tobacco.

The screws 2 have metal surfaces which are heated by a heating medium which is fed into the apparatus 1 via heating medium pipes 10. In the illustrated embodiment, the heating medium is thermal oil which is heated to a desired temperature.

Only part of the tobacco material being treated will be in direct contact with a heated surface at any one time. As the tobacco is conveyed, it will be tumbled and mixed, providing agitation or turbulence of the tobacco material and the required intermittent contact with the heated surface(s). The individual contact time is believed to be no more than a few seconds at a time. The dynamics of the tobacco flow ensures a homogenous treatment of the entire tobacco mass, induced by the shape of the screws.

In the illustrated apparatus, the treatment chamber may be divided into different temperature zones 9. These represent different sections of the screws and these may be separately heated. Therefore, the apparatus can be configured to have surfaces that are heated to varying temperatures. In some embodiments, it may be desirable to control the drying and the searing phases of the treatment by exposing the tobacco to heated surfaces having different temperatures at different points in the treatment process.

In some embodiments, the apparatus comprises a module for carrying out the first expansion step. In some embodiments, the module for carrying out the first expansion step comprises any conventional expansion technology, optionally selected from the group consisting of: an expansion steaming tunnel, an STS (Steam Treated Stem) system, conditioning cylinder, a conditioning screw, or a pressurized conditioning screw. In some embodiments, the module for carrying out the first expansion step comprises one or more of an expansion steaming tunnel and an STS system.

In some embodiments, the module for carrying out the first expansion step further comprises any conventional drying technology, optionally selected from the group consisting of: a fluidized bed dryer, a flash tower dryer, a rotary dryer and a band dryer.

In some embodiments, the apparatus comprises a module for carrying out the third step (such as a reordering step, remoistening step and/or conditioning step). In some embodiments, the module for carrying out the third step comprises one or more selected from the group consisting of: a reordering drum, a steaming tunnel, and a band conditioner Tobacco Industry Products The expanded product (i.e., the treated cut stem tobacco material) provided by the methods according to the present invention may be used in a tobacco industry product. A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn (HnB) products; and c) other nicotine-delivery systems such as inhalers, aerosol generation devices including e-cigarettes, lozenges and gum. This list is not intended to be exclusive, but merely illustrates a range of products which are made and sold in the tobacco industry.

The expanded product may be incorporated into a smoking article.

As used herein, the term 'smoking article' includes smokeable products such as cigarettes, cigars and cigarillos whether based on tobacco, tobacco derivatives, expanded tobacco, reconstituted tobacco or tobacco substitutes and also heat-not-burn products.

The treated tobacco material may be used for roll-your-own tobacco and/or pipe tobacco.

The treated tobacco material may be incorporated into a smokeless tobacco product. 'Smokeless tobacco product' is used herein to denote any tobacco product which is not intended for combustion. This includes any smokeless tobacco product designed to be placed in the oral cavity of a user for a limited period of time, during which there is contact between the user's saliva and the product.

The expanded product may be blended with one or more other tobacco materials before being incorporated into a smoking article or smokeless tobacco product or used for roll-your-own or pipe tobacco. In some embodiments, the expanded product comprising the expanded cut stems can be blended with lamina tobacco and used to form the cut filler to be incorporated into the smokeable material of a smoking article.

EXAMPLES

Example 1

Methods were carried out on Cut Expanded Stem (CES) having a (starting) moisture content of 14.5% OV. A mass of tobacco particles is used as the infeed material and is treated by the methods using an apparatus as shown in FIG. 2.

The process can be described as exposing the particles of CES to hot metal surfaces for seconds, before the individual particles 'fall' back into the overall mass of tobacco material being treated.

The residence time of the mass of tobacco particles within the apparatus (and therefore the treatment period) is between 1 and 5 minutes. The heated metal surfaces are heated by a jacket which is heated as well as the screws, bringing the heated surfaces to the desired temperature, via synthetic oil.

Three different temperature scenarios were tested, namely: 230° C., 240° C. and 250° C. This means that the heating medium (oil) temperature used to heat the heated surfaces was set to these temperatures. This leads to different temperatures in different parts of the apparatus.

The figures and parameters provided in Table 1 below reflect the individual temperatures throughout the treatment process when the heating medium (oil) temperature is set to 250° C.

TABLE 1

Individual Treatment Process Temperatures.

| Parameter | Value |
|---|---|
| Residence time | 180 seconds |
| Set Point temperature | 250° C. |
| Jacket temperature @ exit (14) | 237° C. |
| Screw 1 temperature @ exit | 240° C. |
| Screw 2 temperature @ exit | 240° C. |
| Temperature sensor 1 | 125-147° C. |
| Temperature sensor 2 | 137-164° C. |
| Temperature sensor 3 | 162-180° C. |
| Temperature sensor 4 | 160-187° C. |
| Temperature sensor 5 | 177-192° C. |
| Temperature sensor 6 | 173-198° C. |
| Temperature sensor 7 | 129-151° C. |
| Temperature sensor 8 | 151-183° C. |
| Temperature sensor 9 | 148-186° C. |
| Temperature sensor 10 | 166-189° C. |
| Temperature sensor 11 | 171-195° C. |
| Temperature sensor 12 | 187-204° C. |

In the experiments, the tobacco was treated by processes involving residence times (or treatment periods) of around 2 to 3 minutes and a rate of throughput of tobacco material of around 50 kg/h of cut stem having a moisture content of approximately 14.5% OV.

The process can be split into two different phases. Throughout the first phase, the stem particles are losing their moisture. At a heating medium (oil) temperature of 250° C. the stems have a moisture content of 0% OV after approximately 1 minute. The second phase occurs for the remainder of the treatment and the effect has been termed "searing". Throughout this second phase the main changes are happening.

Table 2 compares the chemical make up of reference stem, untreated cut stem tobacco, with that which is treated in an apparatus which is heated to different heating medium temperatures.

TABLE 2

Chemical Comparison of Comparative and Treated Cut Stem Tobacco

| Tobacco properties | Reference stem | 230° C. | 240° C. | 250° C. |
|---|---|---|---|---|
| Nicotine [% DM] | 0.62 | 0.43 | 0.36 | 0.25 |
| Sugars [% DM] | 13.6 | 5.8 | 3.5 | 2.2 |
| Nitrate [% DM] | 1.61 | 1.65 | 1.64 | 1.92 |
| Ammonium [% DM] | 0.07 | 0.03 | 0.02 | 0.01 |
| Chloride [% DM] | 2.32 | 2.4 | 2.41 | 2.47 |
| Fill value (corrected) [ml/g] | 5.8 | 6.1 | 6.7 | 7 |
| Fill value (measured) [ml/g] | 5.4 | 5.4 | 6 | 7.5 |
| OV [%] | 14.5 | 15.1 | 15 | 12.5 |

As may be seen from Table 2, the nicotine content of the treated expanded cut stem tobacco is reduced by more than 50% at a heating medium temperature of 250° C., total sugars and ammonia by more than 80%. The increase in chloride content reflects a loss of overall organic matter and the significant increase in fill value indicates the changes in the cell structure of the treated tobacco.

The data shows that the cut stem tobacco material undergoes significant changes throughout processing.

It has been shown that these changes translate into changes in the organoleptic properties of the processed material, which are discernible in the smoke produced when the treated tobacco is combusted, for example in a cigarette. The organoleptic properties of this smoke are described in very positive terms by expert smokers, indicating that the tobacco treatment leads to the production of the treated material with beneficial and desirable properties. This is both in terms of the reduction in some undesirable tobacco constituents, and improved organoleptic properties.

Example 2

A conventionally processed Virginia cut stem was used in the following work as a reference material. This cut stem had been conditioned, cut, expanded, dried and air-classified. The expansion of this cut stem was carried out by conventional STS techniques.

In this example, the reference material ("stem after 1$^{st}$ expansion step") is compared to a cut stem that has not been expanded, and a sample that has been treated according to the present invention. This sample has undergone searing as the second expansion step. The searing step was carried out in an apparatus with a heated surface being heated by oil at a temperature of 250° C., a tobacco feed rate of 35 kg/h, and having a 3 minute residence time in the searing chamber. Following the searing step, the sample then underwent a reordering step.

The sample was treated with an 'online' reordering or conditioning step following the searing step. After the searing step, this sample was directly transferred into a conditioning cylinder.

Figure 3:
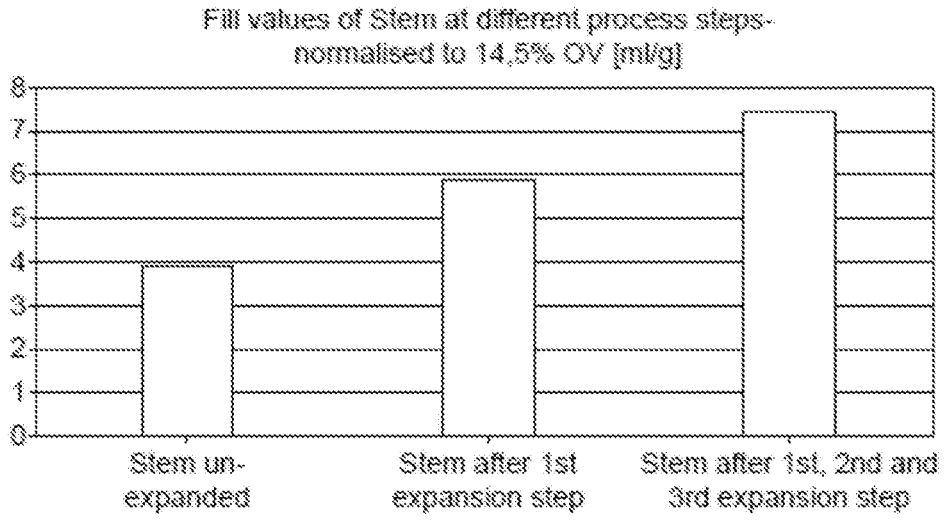
FIG. 3 shows data from experiments incorporating the expanded cut stem tobacco material into a cigarette.

The stem fill values of the different tobacco materials are set out in the graph of FIG. 3. The results indicate that the multiple expansion of stem in accordance with the present invention leads to significantly higher fill values as compared with unexpanded stem and the stem that has only undergone one conventional expansion step by STS techniques.

Example 3

In this example, the expanded cut stem samples of Example 2 were incorporated into the tobacco blend to form tobacco rods for cigarettes. The cigarettes were of a conventional kingsize cigarette design using a conventional cigarette tobacco blend. 17% by weight of the traditional lamina filler was replaced in two test cigarettes with expanded stem, namely the reference material (expanded using a single conventional expansion step), and the multiple expanded cut stem tobacco material of the invention.

Figure 4:
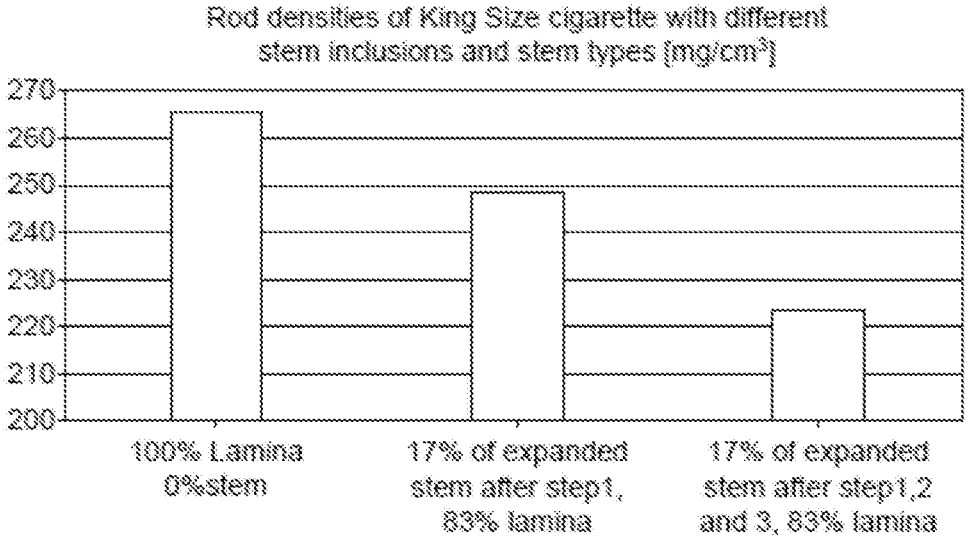
FIG. 4 shows data from experiments incorporating the expanded cut stem tobacco material into a cigarette.

The graph of FIG. 4 shows the resulting rod densities when the different expanded cut stem samples are included in an amount of 17% by weight in the tobacco blend and incorporated into a kingsize cigarette. The resultant cigarettes were assessed and mathematical models used to compare how much tobacco would be needed to make the cigarettes with the same firmness. As the results set out in the graph of FIG. 4 have been calculated using mathematical models, they should be viewed with some caution. Nevertheless, the results indicate that using the multiple expanded stem leads to significantly reduced tobacco input weights when normalized to constant firmness. This also indicates that the higher fill values translate into lower cigarette tobacco rod densities.

In order to address various issues and advance the art, the entirety of this disclosure shows by way of illustration various embodiments in which the claimed inventions may be practiced and provide for superior methods, apparatus and treated tobacco materials and uses thereof. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of treating cut stem tobacco material comprising:

(a) a first expansion step expanding a starting cut stem tobacco material to provide a first expanded tobacco material having a fill value at least about 10% greater than the fill value of the untreated cut stem tobacco material when measured at a normalized moisture content of 14.5% oven volatiles (OV);

(b) a second expansion step expanding the first expanded tobacco material by intermittently contacting the first expanded tobacco material with a heated surface, wherein the first expanded tobacco material is agitated by a heated screw mechanism to provide a second expanded tobacco material having a moisture content from 0 to about 10% OV and a fill value at least 5% greater than the fill value of the first expanded tobacco material when measured at a normalized moisture content of 14.5% OV; and (c) adjusting the moisture content of the second expanded tobacco material from about 10% to about 20% OV to provide an expanded cut stem tobacco product, wherein the fill value of the expanded cut stem tobacco product is at least 50% greater than the fill value of the starting cut stem tobacco material when measured at a normalized moisture content of 14.5% OV, and wherein the heated screw mechanism comprises a helical surface encircling a shaft which is rotated, the helical surface being configured to scoop up and lift at least a portion of the tobacco material being treated as the screw mechanism rotates, to carry the tobacco material and then to allow it to fall away from the screw, so that the tobacco material is in direct and continuous contact with the heated surface for a period of up to about 5 seconds.

2. A method as claimed in claim 1, wherein adjusting the moisture content further expands the second expanded tobacco material.

3. A method as claimed in claim 2, wherein the fill value of the expanded cut stem tobacco product is at least 5% greater than the fill value of the second expanded tobacco material when measured at a normalized moisture content of 14.5% OV.

4. A method as claimed in claim 1, wherein the heated surface used in the second expansion step has a temperature of from at least about 100° C. to about 300° C. prior to contact with the first expanded tobacco material.

5. A method as claimed in claim 4, wherein the heated surface has a temperature from at least about 120° C. to about 250° C., or from at least about 150° C. to about 300° C., prior to contact with the first expanded tobacco material.

6. A method as claimed in claim 1, wherein intermittently contacting the first expanded tobacco material with the heated surface in the second expansion step heats the first expanded tobacco material to a peak temperature of from about 120° C. to about 230° C.

7. A method as claimed in claim 1, wherein the second expanded tobacco material has a moisture content from about 1% to about 5% OV.

8. A method as claimed in claim 1, wherein the first expanded tobacco material is intermittently contacted with the heated surface in the second expansion step for a period of time from at least about 1 minute to about 15 minutes.

9. A method as claimed in claim 8, wherein the period of time is from at least about 2 minutes to about 10 minutes.

10. A method as claimed in claim 1, wherein the starting cut stem tobacco material has a moisture content prior to expanding from about 20% to about 60% OV.

11. A method as claimed in claim 1, wherein the moisture content of the second expanded tobacco material is adjusted from about 10% to about 16% OV.

12. A method as claimed in claim 1, wherein the starting cut stem tobacco material has a fill value prior to the first expansion step from about 3.5 to about 4.5 ml/g when measured at a normalized moisture content of 14.5% OV.

13. A method as claimed in claim 1, wherein the first expanded tobacco material has a fill value from about 5 ml/g to about 8 ml/g when measured at a normalized moisture content of 14.5% OV.

14. A method as claimed in claim 1, wherein the expanded cut stem tobacco product has a fill value from about 6.5 ml/g to about 12 ml/g when measured at a normalized moisture content of 14.5% OV.

15. A method as claimed in claim 1, further comprising a resting phase between the first expansion step (a) and the second expansion step (b), and/or between the second expansion step (b) and the third step (c), wherein the resting phase comprises allowing the tobacco material to rest without being treated for a period of at least about 1 minute.

16. A method as claimed in claim 15, wherein the resting phase comprises allowing the tobacco material to rest without being treated for a period of time from about 1 hour to about 72 hours.

17. A method as claimed in claim 15, wherein the resting phase comprises allowing the tobacco material to cool to a temperature no greater than about 40° C.

18. A method as claimed in claim 1, wherein the first expansion step (a) comprises exposing the starting cut stem tobacco material to an expansion agent.

19. A method as claimed in claim 18, wherein the expansion agent is selected from the group consisting of liquid carbon dioxide, solid carbon dioxide, steam, liquid nitrogen, liquid short (C5 or C6) chain carbohydrates, and mixtures thereof.

20. A method as claimed in claim 1, wherein at least one of water and steam is added to the second expanded tobacco material when adjusting the moisture content of the second expanded tobacco material.

* * * * *